US006401947B1

(12) United States Patent
Hu et al.

(10) Patent No.: US 6,401,947 B1
(45) Date of Patent: Jun. 11, 2002

(54) COMBINATION GARMENT HANGER/ STORAGE APPARATUS

(75) Inventors: Dennic Hu; Thomas Chen, both of Hsin-Chu (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/483,011

(22) Filed: Jan. 13, 2000

(51) Int. Cl.[7] ..... A47B 47/00

(52) U.S. Cl. ..... 211/189; 211/186; 211/206; 312/283

(58) Field of Search ..... 211/186, 189, 211/204, 206; 312/198, 111, 213, 283

(56) References Cited

U.S. PATENT DOCUMENTS

D225,954 S * 1/1973 Schachel ..... D6/414
4,657,317 A * 4/1987 Gemma ..... 211/162 X
5,195,642 A * 3/1993 Dardashti ..... 211/189 X
D335,592 S * 5/1993 Barthelmess et al. ..... D6/414
5,511,594 A * 4/1996 Brennan et al. ..... 141/98
5,555,640 A * 9/1996 Ou ..... 211/204 X
5,865,517 A * 2/1999 Wang ..... 211/204 X
5,894,945 A * 4/1999 Curran ..... 211/206 X

* cited by examiner

*Primary Examiner*—Daniel P. Stodola
*Assistant Examiner*—Erica B Harris
(74) *Attorney, Agent, or Firm*—Tung & Associates

(57) ABSTRACT

The combination garment hanger/storage apparatus is constructed by two up-standing locker members connected thereinbetween by two frame members wherein the upper frame member is further equipped with hook means for hanging worn garments. A plurality of shelves and thus a plurality of rack spaces formed by the shelves are provided in the up-standing locker members for accommodating boots or packaged clean garments. The apparatus can be fabricated of a material that does not produce particle contamination, for instance, of stainless steel. The apparatus is further provided with ventilation apertures in the top panel and in the shelves of the locker unit to promote air circulation and to reduce total weight of the apparatus such that it can be moved in the clean room gowning area.

14 Claims, 2 Drawing Sheets

COMBINATION GARMENT HANGER/ STORAGE APPARATUS

FIELD OF THE INVENTION

The present invention generally relates to a combination garment hanger/storage apparatus for use in a factory and more particularly, relates to a combination garment hanger/storage apparatus for hanging worn garments and for storing clean garments and shoes in a gowning room of a semiconductor fabrication facility.

BACKGROUND OF THE INVENTION

In the recent development of semiconductor fabrication technology, the continuous miniaturization device fabricated demands more astringent requirements in the fabrication environment and contamination control. When the feature size was in the 2 $\mu$m range, a cleanliness class of 100~1,000 (i.e., the number of particles at sizes larger than 0.5 $\mu$m per cubic foot, was sufficient. However, when the feature size is reduces 0.25 $\mu$m, a cleanliness class of 0.1 becomes necessary.

It has been recognized that an inert minienvironment may be the solution to future fabrication technologies when the device size is further reduced. In order to eliminate micro-contamination and to reduce native oxide growth on silicon surfaces, the wafer processing and the loading/unloading procedures of a process tool must be enclosed in a extremely high cleanliness minienvironment that is constantly flushed with ultrapure nitrogen that has no oxygen or moisture.

Different approaches in modern clean room design have been pursued in recent years in the advent of the ULSI technology. One is the utilization of a tunnel concept in which a corridor separates the process area from the service area in order to achieve a high level of air cleanliness. Under the concept, the majority of equipment maintenance functions are conducted in low-classified service areas, while the wafers are handled and processed in more costly high-classified tunnels. For instance, in a process for 16 M and 64 M DRAM products, the requirements of contamination control in a process environment is so stringent that the control of the enclosure of the process environment for each process tool must be considered. In order to maintain the high cleanliness class required, the loading and unloading of the process tool must handled automatically by an input/output device such as a SMIF apparatus. The clothing of the machine operator must also be stringently cleaned without introducing particle contaminations into the clean room.

The continuous monitoring of particles, temperature and humidity conditions inside a clean room is required for alerting engineers to changes occurring in the clean room environment such that steps may be taken to prevent particle-sensitive fabrication processes from drifting out of control. The proper gowning procedure and clean room maintenance practices are both critical to prevent any possible micro-contamination in the clean room.

It has long been recognized that the human operators are major sources of clean room contaminants. For instance, not only the operators generate a large number of contaminants, but also the operators are in close proximity to the wafers at many different stages of the fabrication process. As a result, a proper gowning procedure becomes critical in minimizing the exposure of human hair, bare skin and contaminants carried on street clothes.

To minimize human contamination, it has been a common practice in IC fabrication facilities to require its clean room operators to change from street clothes and street shoes into company-provided clean room suit, a face mask and booties over the street shoes. These clean room suits, masks and booties are worn on the outside of street clothes of clean room operators in a designated area immediately adjacent to a clean room normally known as a gowning room.

A good clean room suit material is normally made of woven fabrics that consist of long synthetic fibers covered with a layer of low friction polymeric material. The polymeric coating material prevents particles from passing through while at the same time allows vapor transmission. The clean room suits and booties are washed regularly using deionized water and sodium-free detergent. Stringent procedures must be followed in providing laundry services to the suits and booties in order to minimize contamination while washing, packaging, transporting, and storing these clean room garments.

To further minimize contamination by the clean room garments, i.e. suits and booties, the storage of such garments becomes an important consideration in designing a gowning room. Not only must the particle contaminants be minimized and strictly controlled, but the unit space required for storing clean room garments for each operator need also be minimized in order to conserve the gowning room area which is frequently limited due to its close proximity to the clean room. In a conventional garment storage area for a clean room, wooden shelves and hangers have been used which become another major source of contaminating particles. Furthermore, the traditional wooden shelves, or shelves made of other material, occupy an excessive volume of space for each clean room personnel, for instance, a volume of space of 0.14 cubic meter per clean room operator is normally required. As clean room operation becomes larger and more complicated such that the number of clean room personnel required increases accordingly, it becomes more critical to conserve the gowning room area in order to maximize the number of clean room personnel it is able to service. The large space requirement of 0.14 cubic meter per clean room personnel becomes unacceptable in modern large-sized clean rooms.

It is therefore an object of the present invention to provide a garment hanger/storage apparatus for use in a clean room gowning area that does not have the drawbacks or shortcomings of the conventional garment hanger/storage apparatus.

It is another object of the present invention to provide a combination garment hanger/storage apparatus for use in a clean room gowning area that maximizes the number of clean room personnel it services.

It is a further object of the present invention to provide a combination garment hanger/storage apparatus for use in a clean room gowning area that minimizes the introduction of contaminants.

It is another further object of the present invention to provide a combination garment hanger/storage apparatus for use in a clean room gowning area that can be used for hanging worn garments, storing clean garments and boots.

It is yet another object of the present invention to provide a combination garment hanger/storage apparatus for use in a clean room gowning area constructed by two up-standing lockers for storing clean garments and boots connected by a frame thereinbetween for hanging worn garments.

It is still another object of the present invention to provide a combination garment hanger/storage apparatus that utilizes less than 0.1 cubic meter per clean room personnel.

It is yet another further object of the present invention to provide a combination garment hanger/storage apparatus that utilizes only 0.07 cubic meter per clean room personnel.

SUMMARY OF THE INVENTION

In accordance with the present invention, a combination garment/storage apparatus for storing clean garments and boots and hanging worn garments in a clean room gowning area is provided.

In the preferred embodiment, a combination garment hanger/storage apparatus is provided which includes a first locker and a second locker arranged in a back-to-back spaced apart relationship having a first distance thereinbetween. The first locker has a first side facing the second locker and a backside sealed by a side panel and a back panel respectively, a second side facing away from the second locker and a front side arranged in a plurality of racks formed by a plurality of shelves for storing garments and shoes. The second locker has a first side facing the first locker and a back side sealed by a side panel and a back panel respectively, and a second side facing away from the first locker and a front side arranged in a plurality of racks formed by a plurality of shelves for storing garments and shoes. An upper frame that has a length of a first distance connecting an upper end of the side panel of the first locker to an upper end of the side panel of the second locker for hanging garments thereon. A lower frame that has a length of a first distance connecting a lower end of the side panel of the first locker to a lower end of the side panel of the second locker for providing structural rigidity to the combination garment hanger/storage apparatus.

In the combination garment hanger/storage apparatus, the plurality of racks further includes racks for garments and racks for shoes. The plurality of racks may further include racks for clean garments and racks for boots. The upper frame may further include a plurality of hook means for hanging garments. The first locker, the second locker and the upper frame may be sufficient for storing and hanging at least 50 worn garments, 50 clean garments and 50 pairs of shoes. The upper frame may further include at least 50 hook means for hanging worn garments. Each of the first and second lockers may have a top panel provided with ventilation apertures. Each of the first and second lockers may be equipped with wheels mounted on a bottom panel for rollingly engaging a floor surface and for rollingly moving the combination garment hanger/storage apparatus. The first locker, the second locker and the upper and lower frames may be fabricated of a material that does not generate contaminating particles or fabricated of stainless steel.

In another preferred embodiment, the present invention provides a garment hanger/storage rack that includes a first up-standing locker that has at least one side sealed by a panel and at least two sides provided with open shelves sufficient to store at least 25 clean garments and at least 25 pairs of boots, a second up-standing locker that has at least one side sealed by a panel and at least two sides provided with open shelves sufficient to store at least 25 clean garments and at least 25 pairs of boots, an upper frame connecting a top portion of one of the at least one sealed panel on the first up-standing locker to a top portion of one of the at least one sealed panel on the second up-standing locker for hanging at least 50 worn garments and a lower frame connecting a bottom portion of one of the at least one sealed panel on the first up-standing locker to a bottom portion of one of the at least one sealed panel on the second up-standing locker for providing structural rigidity of the garment hanger/storage rack. A second frame may further include at least 50 hook means for hanging the at least 50 worn garments. A total volume of space needed for a worn garment, a clean garment and a pair of boots per each personnel is not more than 0.1 $m^3$. Each of the first and second up-standing lockers has a top panel equipped with ventilation apertures. Each of the first and second up-standing lockers is equipped with a bottom panel and at least 4 wheel means mounted on each bottom panel for slidingly engaging a floor surface. Each of the upper frame and the lower frame has a length sufficient for hanging and a cross-sectional area sufficiently rigid for supporting at least 50 garments. The first and second lockers and the upper and lower frames are fabricated of stainless steel.

BRIEF DESCRIPTION OF THE DRAWINGS

These and other objects, features and advantages of the present invention will become apparent from the following detailed description and the appended drawings in which.

DETAILED DESCRIPTION OF THE PREFERRED EMBODIMENT

The present invention discloses a combination garment hanger/storage apparatus that can be advantageously used in a semiconductor fabrication plant clean room gowning area for hanging worn garments and storing clean garments and boots. According to a preferred embodiment of the present invention, each of the apparatus includes two up-standing lockers connected by an upper frame and a lower frame that has the capacity of hanging 56 worn garments, storing 56 clean garments and 56 pairs of boots.

Based on the present invention novel apparatus, the unit space required for each clean room personnel for storing and hanging clean room garments and boots is reduced from about 0.14 cubic meters to 0.07 cubic meters. By using the present invention novel apparatus, the per person space required for clean room personnel is reduced by 50%. The gowning area for a clean room facility therefore need not be expended even when total clean room personnel has increased.

The present invention combination garment hanger/storage apparatus can be advantageously fabricated of a material that does not produce particle contamination. A suitable material is stainless steel which provides greatly improved garment hangers and storage units that are conventionally fabricated of wood and thus eliminating contaminating particles.

Figure 1:
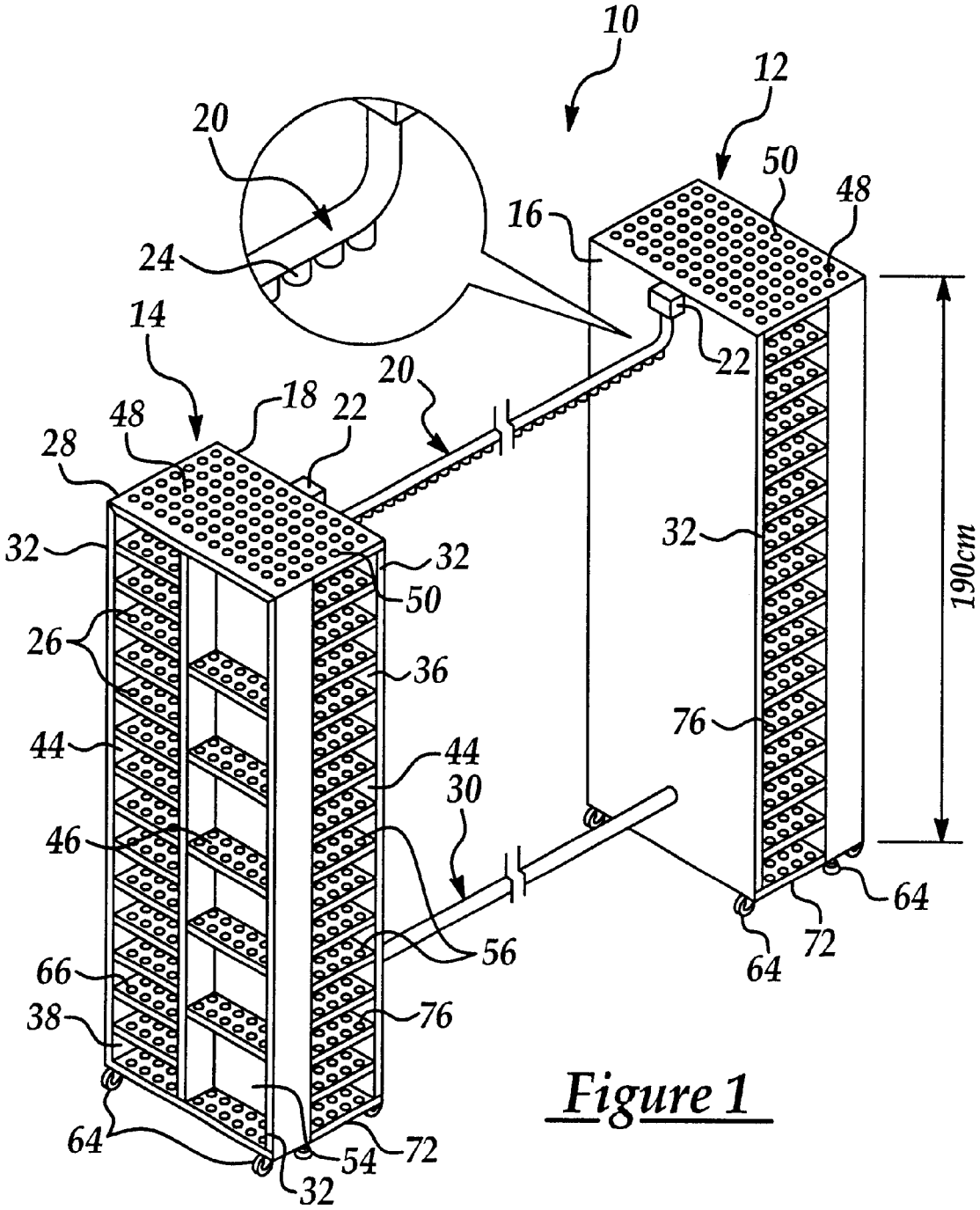
FIG. 1 is a prospective view of the present invention combination garment hanger/storage apparatus constructed by two lockers, an upper frame member and a lower frame member.

Referring now to FIG. 1 wherein a present invention combination garment hanger/storage apparatus 10 is shown. The apparatus 10 is constructed by a first up-standing locker 12 and a second up-standing 14 arranged in a back-to-back, spaced-apart relationship wherein the back panel 16 of the first locker 12 and the back panel 18 of the second locker 14 are connected together by an upper frame member 20. The upper frame member 20 is attached to the back panels 16, 18 by fastening means 22 such as a fastening block and bolts (not shown). The upper frame member 20 is further provided with a plurality hook means 24 for hanging clean room garments.

As shown in FIG. 1, the first up-standing locker 12 and the second up-standing locker 14 are mounted in a back-to-back manner by an upper frame member 20, and furthermore by a lower frame member 30 to improve the structural rigidity of the apparatus 10. The upper frame member 20 and the lower frame member 30 may each be constructed in a tubular form having a rectangular cross-section or a circular cross-section. A suitable high rigidity material used for such construction is stainless steel.

As shown in the second up-standing locker 14, the side 18 and the back side 28 are each sealed by a panel to frame 32. The other two sides 36 and 38 remain open and are provided with a plurality of shelves 26, 46 and 56. In-between the shelves 26, 46, and 56, a plurality of rack spaces 44 and 54 is provided for storing clean room boots and clean room garments, respectively. The larger rack space 54 can be used to store numerous clean room garments that are cleaned and wrapped in plastic cover, for instance, each rack space 54 is sufficiently large to accommodate 5 or 6 wrapped garments. Each rack space 44 is designed such that it is sufficiently large for storing a pair of clean room shoes. The arrangement of the rack spaces 44 and 54 is further shown in FIGS. 2 and 3.

Figure 2:
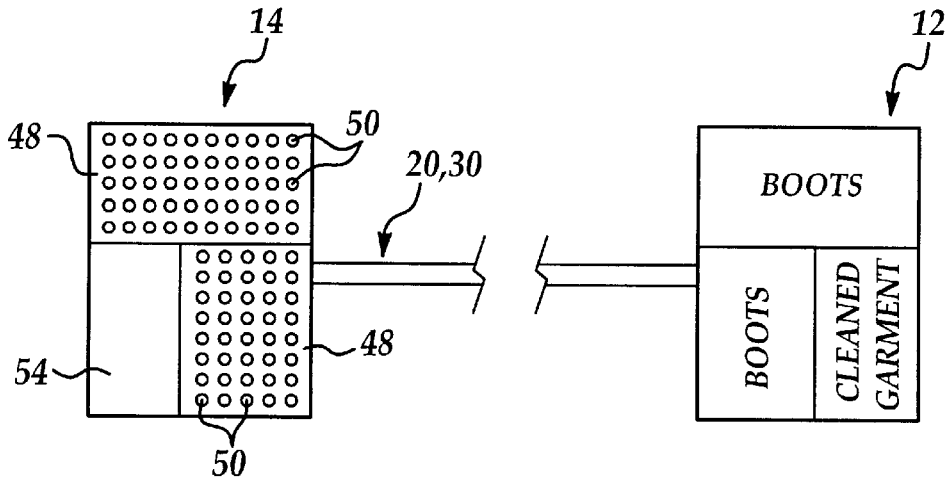
FIG. 2 is a top view of the present invention combination garment hanger/storage apparatus.

As shown in FIG. 2, the top panel 48 of the second up-standing locker member 14 and the first up-standing locker member 12 are provided with a multiplicity of ventilation apertures 50. The ventilation apertures 50 provide suitable ventilation in the gowning area and thus further promote improved uniformity of air temperature. The ventilation apertures 50 also provide the benefit of reducing the weight of the top panels such that apparatus 10 can be easily moved around in the gowning area when necessary. Similar ventilation apertures 66,76 are further provided in shelves 26, 46, and 56 for achieving the same desirable result.

On the bottom panel 72 for the first and second lockers 12,14 is further provided a plurality of wheel means 64. For instance, as shown in FIG. 1, a total of six wheel means 64 are provided on each of the lockers such that apparatus 10 rollingly engages a floor surface to be moved around in a gowning area. As shown in FIG. 1, a typical height of the up-standing locker 12,14 is about 190 cm such that the top-most shelf 26,56 can be reached by a person of average height.

On the upper frame member 20, a multiplicity of hook means 24, i.e. up to 56 hook means, may be provided for accommodating 56 clean room garments. Since garments are usually cleaned on weekly basis, there are always clean garments available (provided in plastic wrap) which are advantageously stored in rack space 54 or on shelf 46 for replacing dirty clean room garments.

Figure 3:
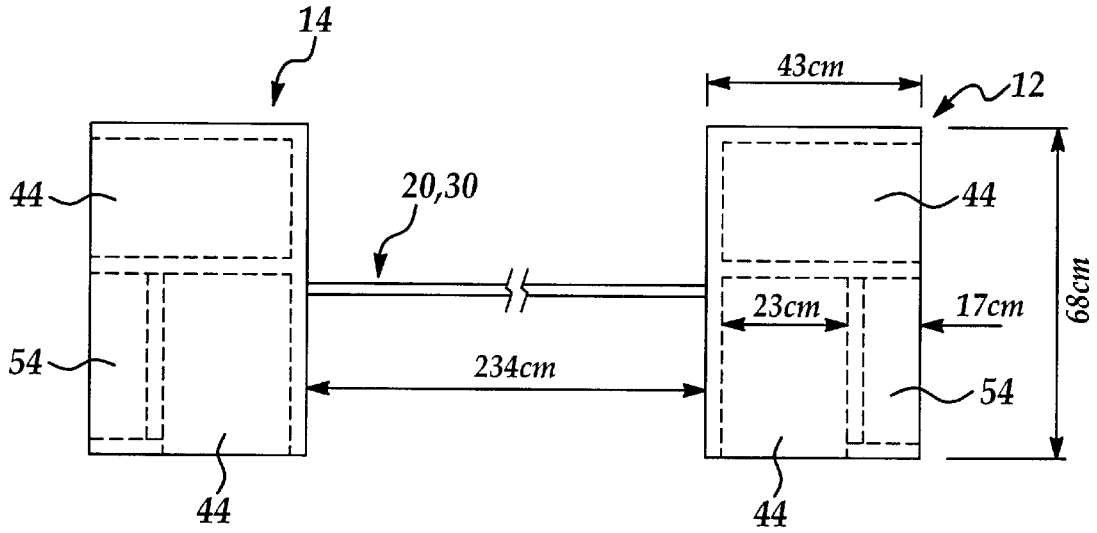
FIG. 3 is a plane view of the present invention combination garment hanger/storage apparatus showing various dimensions.

Other suitable dimensions for the present invention novel combination garment hanger/storage apparatus are shown in FIG. 3. For instance, the distance between the two up-standing lockers 12 and 14 may be suitably 234 cm for accommodating 56 clean room garments by providing approximately 4.2 cm space for each garment. Each of the first and second up-standing lockers 12,14 may be formed in a dimension of about 43 cm×68 cm. The width of the shelves 56 for storing clean room boots may be about 23 cm which is adequate for storing boots of all sizes.

The present invention novel combination garment hanger/storage apparatus has therefore been amply described in the above description and in the appended drawings of FIGS. 1–3.

While the present invention has been described in an illustrative manner, it should be understood that the terminology used is intended to be in a nature of words of description rather than of limitation.

Furthermore, while the present invention has been described in terms of a preferred and alternate embodiment, it is to be appreciated that those skilled in the art will readily apply these teachings to other possible variations of the inventions.

The embodiment of the invention in which an exclusive property or privilege is claimed are defined as follows:

1. A combination garment hanger/storage apparatus comprising:

a first locker and a second locker arranged in a back-to-back spaced-apart relationship having a first distance there-in-between;

said first locker having a first side panel facing said second locker, a back panel, a second side facing away from said second locker including a plurality of shelves and a front side including a plurality of shelves for storing garments and shoes;

said second locker having a first side panel facing said first locker, a back panel, a second side facing away from said first locker including a plurality of shelves and a front side including a plurality of shelves for storing garments and shoes;

an upper frame having a length of said first distance connecting an upper end of side panel of said first locker to an upper end of said side panel of said second locker for hanging garments thereon, said upper frame further comprises a plurality of hooks; and a lower frame having a length of said first distance connecting a lower end of said side panel of said first locker to a lower end of said side panel of said second locker for providing structural rigidity to said combination garment hanger/storage apparatus.

2. A combination garment hanger/storage apparatus according to claim 1, wherein said first locker, said second locker and said upper frame store and hang at least 50 worn garments, 50 clean garments and 50 pairs of shoes.

3. A combination garment hanger/storage apparatus according to claim 1, wherein said upper frame further comprises at least 50 hook means for hanging worn garments.

4. A combination garment hanger/storage apparatus according to claim 1, wherein said first and second lockers each has a top panel provided with ventilation apertures.

5. A combination garment hanger/storage apparatus according to claim 1, wherein said first and second lockers are each equipped with wheels mounted on a bottom panel for rollingly engaging a floor surface and for rollingly moving said combination garment hanger/storage apparatus.

6. A combination garment hanger/storage apparatus according to claim 1, wherein said first locker, said second locker and said upper and lower frames are fabricated of a material that does not generate particles.

7. A combination garment hanger/storage apparatus according to claim 1, wherein said first locker, said second locker and said upper and lower frames are fabricated of stainless steel.

8. A garment hanger/storage rack comprising:

a first up-standing locker of rectangular cross-section having at least one side sealed by a panel and at least two sides, each side provided with open shelves to store at least 25 clean garments and at least 25 pairs of boots;

a second up-standing locker of rectangular cross-section having at least one side sealed by a panel and at least two sides provided with open shelves to store at least 25 clean garments and at least 25 pairs of boots;

an upper frame connecting a top portion of one of said at least one sealed panel on said first up-standing locker to a top portion of one of said at least one sealed panel on said second up-standing locker for hanging at least 50 worn garments, wherein a side opposite to said at least one sealed panel to which said upper frame is connected and a front side of said lockers constitute said at least two sides; and a lower frame connecting a bottom portion of one of said at least one sealed panel on said first up-standing locker to a bottom portion of one of said at least one sealed panel on said second up-standing locker for providing structural rigidity of said garment hanger/storage rack.

9. A garment hanger/storage rack according to claim 8, wherein said upper frame further comprises at least 50 hook means for hanging said at least 50 worn garments.

10. A garment hanger/storage rack according to claim 8, wherein a total volume of space provided for a worn garment, a clean garment and a pair of boots is not more than 0.1 $m^3$.

11. A garment hanger/storage rack according to claim 8, wherein said first and second up-standing lockers each has a top panel equipped with ventilation apertures.

12. A garment hanger/storage rack according to claim 8, wherein said first and second up-standing lockers are each equipped with a bottom panel and at least four wheel means mounted on each bottom panel for rollingly engaging a floor surface.

13. A garment hanger/storage rack according to claim 8, wherein said upper frame and said lower frame each has a length for hanging and a cross-sectional area for supporting at least 50 garments.

14. A garment hanger/storage rack according to claim 8, wherein said first and second lockers and said upper and lower frames are fabricated of stainless steel.

* * * * *